United States Patent [19]

Murasaki et al.

[11] 4,230,070

[45] Oct. 28, 1980

[54] DEVICE FOR AUTOMATICALLY REPLENISHING TONER TO DRY-TYPE DEVELOPING APPARATUS FOR ELECTROPHOTOGRAPHY

[75] Inventors: Hiroshi Murasaki, Sakai; Masaya Ogawa, Osaka; Hidetoshi Kawabata, Tondabayashi, all of Japan

[73] Assignee: Minolta Camera Kabushiki Kaisha, Osaka, Japan

[21] Appl. No.: 934,121

[22] Filed: Aug. 16, 1978

[30] Foreign Application Priority Data

Aug. 24, 1977 [JP] Japan ..... 52-113924[U]
Feb. 18, 1978 [JP] Japan ..... 53-19827[U]

[51] Int. Cl.[2] ..... G03G 15/09

[52] U.S. Cl. ..... 118/658; 118/657; 222/DIG. 1; 355/3 DD

[58] Field of Search ..... 118/DIG. 1, 657, 658; 222/DIG. 1; 355/3 DD

[56] References Cited

U.S. PATENT DOCUMENTS

| | | | |
|---|---|---|---|
| 3,152,012 | 10/1964 | Schaffert | 355/3 DD X |
| 3,453,045 | 7/1969 | Fantuzzo | 355/3 DD |
| 3,929,098 | 12/1975 | Liebman | 355/3 DD X |
| 3,941,084 | 3/1976 | Kurita | 118/657 X |
| 4,018,187 | 4/1977 | Abbott et al. | 118/658 |

FOREIGN PATENT DOCUMENTS

| | | | |
|---|---|---|---|
| 52-63739 | 5/1977 | Japan . | |
| 1396979 | 6/1975 | United Kingdom | 96/1.4 |

*Primary Examiner*—Roland E. Martin, Jr.
*Attorney, Agent, or Firm*—Wolder, Gross & Yavner

[57] ABSTRACT

In a dry-type developing apparatus for use in electrophotography including a developing sleeve for conveying a two-component developer composed of a toner and a carrier to a developing station, an automatic toner replenishing device comprises a roller to which voltage is applied having recessed toner dispenser portions and a toner recovering peripheral surface portion on its periphery and rotatable in contact with a portion of the developer on the sleeve after the developer portion has passed through the developing station, bias voltage sources connected to the sleeve and to the roller respectively to produce a potential difference between the sleeve and the roller, and a toner tank arranged to cover part of the roller and containing the toner to be replenished.

16 Claims, 6 Drawing Figures

DEVICE FOR AUTOMATICALLY REPLENISHING TONER TO DRY-TYPE DEVELOPING APPARATUS FOR ELECTROPHOTOGRAPHY

BACKGROUND OF THE INVENTION

The present invention relates to a device for automatically replenishing toner to a dry-type developing apparatus for use in electrophotographic copying machines.

Developing apparatus of the subject type include in their upper portion a toner tank from which toner is dispensed at a constant rate usually by gravity or with a rotating brush, roller or the like provided at a toner outlet. The supply of toner is controlled generally from outside by mechanical means in accordance with the density of the observed copy images.

With such a dispenser, however, it is impossible to replenish the toner in proportion to the aggregate or charge on the electrostatic latent images which vary greatly with the denisty of the original. Thus when continuously developing electrostatic latent images of low aggregate charge, the quantity of toner within the developing apparatus increases to an excessive level, with the possible result that fog occurs in the non-image areas due to the deposition of toner thereon or the excess toner emits a fume to stain the interior of the copying machine. Conversely continuous development of electrostatic latent images of large aggregate charge will result in a deficiency of toner, producing copy images of reduced density or allowing carrier beads to adhere to the photosensitive element.

Accordingly a toner dispenser is required which will replenish toner in proportion to the density of the original, namely to the aggregate charge on the photosensitive element. Various devices of this type heretofore proposed include those which measure the density of the original images or copy images and control the supply of toner in accordance with the measurement, and those adapted to control the toner supply based on the amount of charge measured on the surface of the photosensitive element. The proposed devices nevertheless have the drawbacks of being complex, large-sized and expensive and failing the assure efficient and accurate control.

To overcome these problems, toner dispensers have been proposed in U.S. Pat. No. 3,453,045 and Japanese Laid-Open Patent Application No. SHO52-63739.

The dispenser described in the above U.S. patent comprises a guide plate for guiding the developer from a conveyor to the developing station and toner dispenser roller arranged for contact with the developer flowing over the guide plate and having the same triboelectric characteristics as the carrier. The roller, when driven in contact with a supply of toner in a toner tank, electrostatically attracts some of the toner on its surface and continuously brings the toner into contact with the developer on the guide plate to replenish the developer on the guide plate with the toner until the developer has been saturated therewith, namely until the amount of toner electrostatically attracted to the carrier has reached the saturation level. Thus the developer is fed to the developing station where it is always maintained at a constant toner concentration independently of the electrostatic latent images to be developed. The U.S. patent also proposed to control the optimum toner concentration by controlling the saturation level with an adjustable bias voltage applied to the dipenser roller and to thereby produce a variable contrast.

With the dispenser described in the laid-open Japanese application, the developer advanced on a developing sleeve or conveyor and passing through the developing station is wholly or partially directed by a guide member toward a toner recovering conductive roller to which is applied a bias voltage at a polarity opposite to that of the toner and which contacts the developer flowing on the guide member to electrostatically attract toner from the developer to the roller surface. The toner continuously attracted and recovered by the roller by virtue of its rotation is received in a toner tank. The developer is continuously or intermittently replenished with toner which is dispensed from the toner tank by another roller, such that when the developer has an optimum toner concentration, an amount of toner, equal to the amount F of toner recovered by the conductive roller within a specified short period of time To, is replenished from the toner tank by the dispenser roller during each timer period To. The amount F is made equal to $Mt+F_1$ wherein Mt is the average amount of toner consumed by the development within the specified time To, and $F_1$ is the amount of toner recovered by the conductive roller from the developer within the time To after the amount Mt has been consumed. In this way, a constant amount of toner is replenished (during the period of time To) independently of the electrostatic latent images to be developed. It is also explained that when $Mt+F_1$ differs from F depending on the kind of original, the value $Mt+F_1$ is made equal to F by controlling the bias voltage value on the conductive roller and/or adjusting the speed of rotation of the roller.

However, both the proposed devices leave much to be desired,

Whereas the toner dispenser roller of the former must be provided with the same triboelectric characteristics as the carrier, it is difficult for the roller to maintain such characteristics over a prolonged period of time since toner adheres on the roller surface and consequently impairs the triboelectic function of the roller. This results in a reduction in the amount of charges on the toner per se, giving rise to difficulties in maintaining the initial toner concentration. The bias voltage, if controlled, is unable to obviate this problem.

With the latter, the relationship of $F=Mt=F_1$ could be maintainable insofar as fluctuating factors such as the kind of original and the frequency of the copying operation are held at average levels within the specificed time period To, but the definite relationship involved in the toner supply F is fundamentally difficult to maintain in an actual operation which handles images having changing factors. In fact, the concentration of the toner to be conveyed to the developing station inevitably varies over a wide range.

Consequently when the density of copy images has greatly changed in the course of a copying operation, there arises the necessity of adjusting the toner concentration by controlling the bias voltage and/or the speed of rotation of the recovery roller as in other conventional devices. Moreover, such adjustment is frequently necessary.

Further characterizing the foregoing mechanisms, are that the former requires a guide plate, whereas the latter requires a guide member and both a toner recovery roller and a toner dispenser roller. Either of the proposed constructions therefore necessitates provision of the guide plate, or the guide member and toner recovery roller as additional means and is accordingly more complicated than is desired.

SUMMARY OF THE INVENTION

An object of the invention is to provide in a dry-type developing apparatus in an electrostatic copying machine an improved automatic toner replenishing device for maintaining a satisfactory of optimum toner concentration over a prolonged period of time.

Another object of the present invention is to provide an improved automatic toner replenishing device which maintains a satisfactory toner concentration even for images of varying characteristics, namely for original images of varying densities.

Still another object of the present invention is to provide an improved automatic toner replenishing device of very simple construction and reliably assuring the desired toner concentration.

A further object of the present invention is to provide an improved automatic toner replenishing device which maintains a substantially constant toner concentration by changing the overall toner supply rate in accordance with variations in the denisty of the original.

Still a further object of the present invention is to provide an improved automatic toner replenishing device which always maintains a constant toner concentration with high efficiency and high stability despite variations in the denisty of the original.

The above and other objects of the present invention will become apparent from a reading of the following description taken in conjunction with the accompanying drawings.

In accordance with the present invention there is provded in a dry-type developing apparatus for converting electrostatic latent images into visible images with a two-component developer composed of a triboelectrically chargeable toner and a magnetic carrier having an electrically conductive or insulative peripheral surface and conveyed to a developing station by a developing sleeve having a plurality of magnets arranged in its interior; an improved automatic toner replenishing device comprising a roller (or rotatable cylinder) to which voltage is applied and which consists of a conductive roller formed with or without an insulative layer on its peripheral surface, wherein said roller having at least one recessed toner dispenser portions and a toner recovering surface portion on its periphery and rotatable in a contact with a portion of the developer on the sleeve after the developer portion has passed through the developing station, bias voltage sources connected to the sleeve and to the roller respectively to produce a potential difference between the sleeve and the roller, and a toner tank arranged to cover part of the roller and containing the toner to be replenished.

DESCRIPTION OF THE PREFERRED EMBODIMENTS

Figure 1:
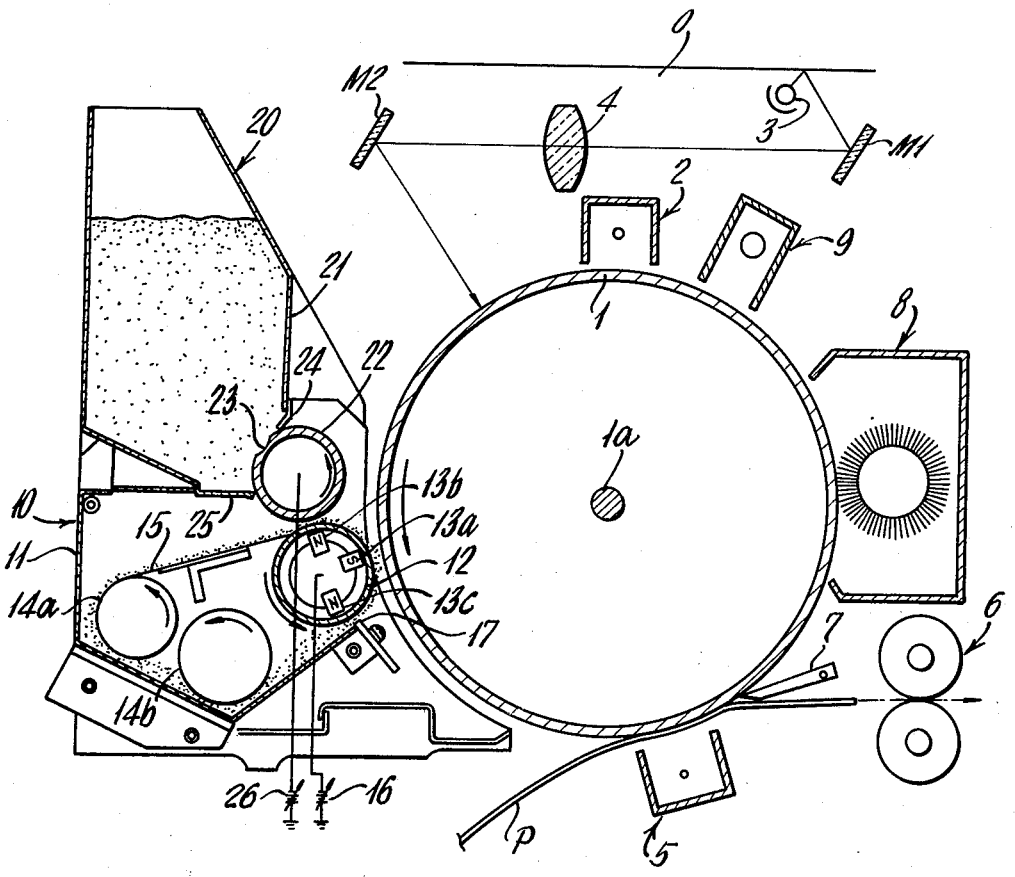
FIG. 1 is a schematic side sectional view of a transfer type electrophotographic copying apparatus in which an automatic toner replenishing device and a developing appaatus according to the present invention are provided.
Figure 2:
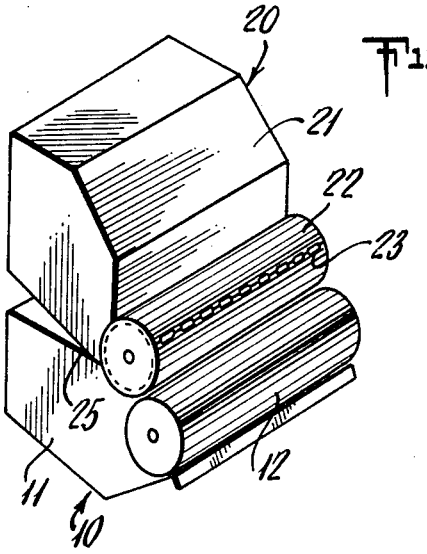
FIG. 2 is a perspective view of the toner replenisher device and developing apparatus.

Referring now to the drawings, particularly FIGS. 1 to 4 which illustrate a preferred embodiment of the present invention, the reference numeral 1 generally designates a photosensitive member which may be of known composition and is provided around the periphery of a drum which in turn is mounted on the rotatable with a coaxial shaft 1*a* in the direction shown by the arrow by a suitable drive means associated with the copying cycle. Thus the photosensitive member is, by way of illustration, of the drum type.

Around the sensitive drum 1 are provided, in the following order; a corona charging device 2 for applying a negative static electrical charge to the surface of the photosenstive member; an exposure station for projecting onto the surface of the negatively charged sensitive drum an image of an original document 0 illuminated by an exposure lamp 3, through a projecting optical system consisting of a mirror $M_1$, a projection lens 4 and a mirror $M_2$ to produce an electrostatic latent image; a developing device 10 for applying to the photosentive surface positive static electrically charged toner particles to produce a toner image of the latent image; a corona charging device 5 for transferring the image of toner particles onto a copy sheet P fed from a copy-sheet-feeding roller (not shown); a pawl 7 for separating the copy sheet P from the surface of the sensitive drum 1 so that the developed or toner image bearing copy sheet P may be transported to a fixing device 6; a cleaning device 8 for removing residual toner particles from the surface of the photosensitive drum 1; and an eraser lamp 9 for removing residual electrostatic charge remaining on the surface of the drum 1. The arrangement in the above-described order is typical of a powder-image transfer type, electrophotographic copying machine.

The developing device 10 is of the magnetic brush type and includes a developing sleeve 12 having stationary magnets 13*a*, 13*b*, 13*c* in its interior and accommodated in a developer tank 11. The developing sleeve 12 is positioned close to the photosensitive drum 1 and is rotatable in a counterclockwise direction as viewed in FIG. 1. The developing apparatus 10 further includes a pair of stirring rollers 14*a*, 14*b* which are rotatable counterclockwise as viewed in FIG. 1 and a developer scraping plate 15 extending from the peripheral surface of developing sleeve 12 to the peripheral surface of the stirring roller 14*a* over the space therebetween. A variable bias voltage source 16 impresses suitable bias voltage on the developing sleeve 12. As the sleeve 12 rotates, particles of a known two-component developer composed of a magnetic carrier having an electrically conductive peripheral surface and a toner are magnetically urged and oriented by the internal stationary magnets 13*a*, 13*b*, 13*c* to form a brush on the periphery of the sleeve 12. The magnetic brush formed by the magnet 13*a* opposed to the photosensitive drum 1 comes into contact with the electrostatic latent image on the photosensitive drum 1 to develop the image in the known manner. The height of the magnetic bristles or fibers of the brush is regulated by a regulating plate 17 disposed proximate the peripheral surface of sleeve 12.

An automatic toner replenishing device 20 in accordance with the present invention comprises a toner tank 21 and an electrically conductive roller 22 formed with an insulative layer on its peripheral surface provided at a lower portion of and in communication with the tank 21 and rotatable in a counterclockwise direction as viewed in FIG. 1. The roller 22 serves to replenish toner and also to recover toner. The roller 22 is engaged at its upper part by a seal member 24 and at its lower part by a blade 25 of suitable elastic material where the toner tank 21 is open to the developer tank 11. The roller 22 is positioned proximate and parallel to the developing sleeve 12 and in opposed relation to the magnet **13*b* housed in the sleeve 12 which magnet is displaced from the photosensitive drum 1. An adjustable bias voltage source 26 applied suitable bias voltage to the roller 22 to produce a potential difference between the roller 22 and the developing sleeve 12 to which a bias voltage is applied by the source 16. At the position where the periphery of the roller 22 is closed to that of the developing sleeve 12, the peripheral surface of the roller 22 rotates or moves in an opposite direction to that of the sleeve 12 and comes into sliding contact or engagement with the magnetic brush formed by the magent 13*b* on the sleeve 12** from the portion of the developer which has passed through the developing station.

Figure 3:
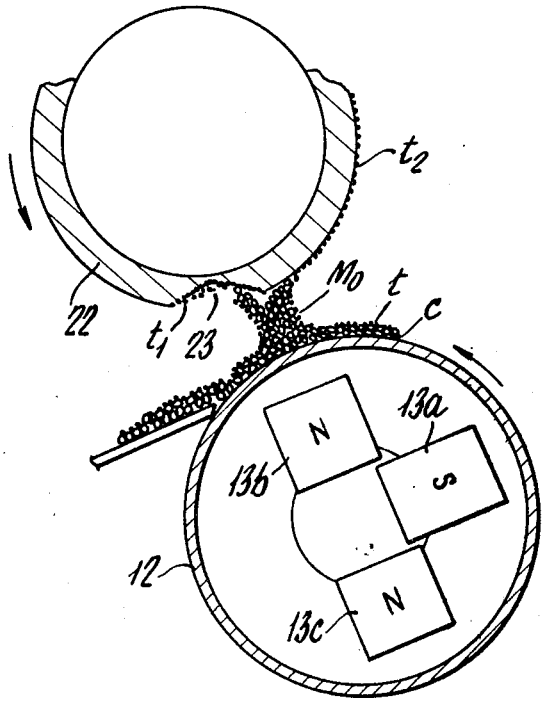
FIG. 3 is a fragmented transverse sectional view of a main part thereof.

The roller 22 has formed in its peripheral surface a plurality of recessed toner dispenser portions 23 arranged axially or longitudinally thereof. As seen in FIG. 3, the recessed portions 23 facilitate mechanical deposition of toner particles as by being formed with minute projections or a multiplicity of grooves. As the roller 22 rotates, the recessed portions 23 serve to replenish the developer tank 11 with the portion of the toner carried by or contained in the recessed portions 23 by dropping such toner under the influence of gravity and also to carry another portion of the toner as mechanically or electrostatically attracted thereto to the position where the toner portion is brought into contact with the magnetic brush formed by the magnet **13*b***.

The blade 25 functioning as a scraper and doctor is held in sliding contact with the peripheral surface of the roller 22 at all times, whereby the toner particles adhering to the peripheral surface other than the recessed portions 23 are scraped off into the toner tank 21, while allowing a predetermined quantity of toner to fill the recessed portions 23.

Considering now the movement of the developer (toner and carrier) with reference to FIG. 3, with the counterclockwise rotation of the roller 22, the recessed portions 23 pass through the toner tank 21 and advance carrying the predetermined quantity of toner therein as regulated by the edge of the blade 25 and continue to advance toward the position where the roller 22 is closed to the sleeve 12 in opposed relation thereto. As the recessed portions 23 approach the developing sleeve 12, the toner filling the recessed portions 23 partly falls off under the influence of gravity and is admixed with the developer on the sleeve 12. The remaining portion $t_1$ of the toner as mechanically and electrostatially attracted to the recessed portions 23 is continuously carried toward the magnetic brush MO formed by the stationary magnet **13*b***.

On the other hand, with the counterclockwise rotation of the developing sleeve 12, toner is consumed for the development of the electrostatic latent images on the photosensitive drum 1, and carrier c with only a small amount of toner t clinging thereto conveyed to the position opposed to the roller 22. At this position, beads of carrier c are influenced by the magnet **13*b* to form a magnetic brush or bristle MO, rubbing or withdrawing toner particles $t_1$ off the recessed portions 23 by the electrostatic forces of carrier beads c overcoming the mechanical and electrostatic forces by which the toner particles are held attracted to the recessed portions 23. After the recessed portions 23 have passed the above-mentioned position, the magnetic brush MO comes into contact with the insulative layer formed outer peripheral face of roller 22. Since bias voltages are impressed on the developing sleeve 12 and roller 22 (with a greater potential being applied to the roller 22 in absolute value), a quantity of toner t contained in the magnetic brush MO is electrostatially attracted to the periphery of the roller 22 and recovered into the toner tank 21 to give the desired developer concentration. Thus the roller 22, with its recessed portions 23, acts to supply toner from the toner tank 21 to the developer tank 11 by the gravity acting on the toner and also by the attracting force of the carrier c on the developing sleeve 12. The roller 22** further functions to electrostatically recover excess toner $t_2$ after the development by reason of bias voltages.

Accordingly when latent images on the photosenstive drum 1 having a very small amount of charges or aggregate charge have been developed with little or no comsumption of the toner on the developing sleeve 12, the carrier beads c conveyed on the sleeve 12 to the position opposed to he roller 22 as shown in FIG. 3 have sufficient toner particles t around their surfaces, with the result that the toner $t_1$ adhering to the recessed portions 23 will not be rubbed off by the carrier c but the excess $t_2$ of the toner attracted to the carrier c will be attracted to the peripheral surface of the roller 22 for recovery.

Conversely when the toner on the sleeve 12 has been almost completely consumed for the development of latent images on the drum 1 having a very large aggregate charge or amount of charges, the carrier c almost depleted of toner t will attract the toner $t_1$ off the recessed portions 23, while leaving little or no toner $t_2$ on the periphery of the roller 22 for recovery.

Figure 4:
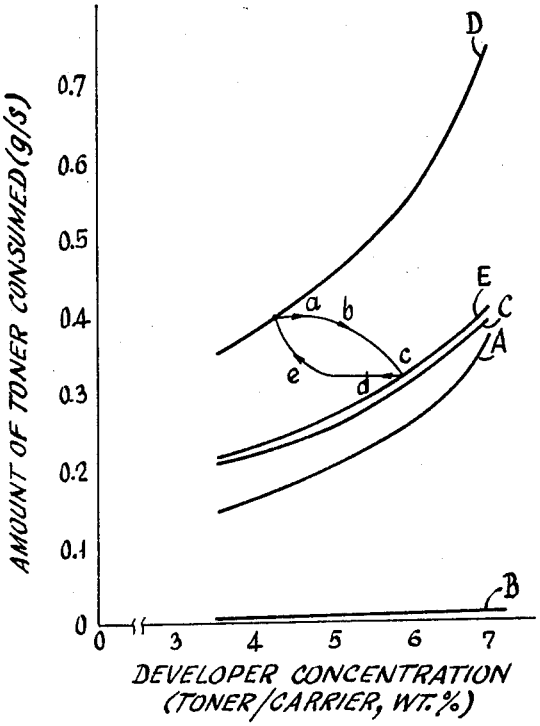
FIG. 4 is a graph showing the relation between the toner consumption and the developer concentration in the apparatus of FIG. 1.

FIG. 4 is a graph illustrating the foregoing phenomena in terms of the relation between the toner supply and the developer concentration (toner-to-carrier ratio).

In the graph, the developer concentration (toner/carrier, wt.%) is plotted as abscissa vs. the amount of toner consumed (i.e. deposited on the photosensitive element) or the amount of toner recovered by the roller as attracted thereto, per second, and the sum of the amounts (all in g/s) plotted as ordinate.

Curve A represents the relation between the developer concentration and the amount of toner deposited on the photosensitive element when the latent images on the element have the largest amount of charges (development of entirely black surface original images). Curve B represents the relation between the developer concentration and the amount of toner deposited on the photosensitive element (fogging) when the latent images on the element have the smallest amount of charges (development of entirely white surface original images). Curve C represents the relation between the developer concentration and the amount of toner $t_2$ attracted onto the periphery of the roller for recovery. Curve C can be altered by controlling the amount of toner to be deposited on the roller namely by modifying the quality of the material of the roller or controlling the peripheral speed of or the bias voltage on the roller.

Curve D is the composition of Curves A and C, and Curve E is the composition of Curve B and C.

Variations in the developer concentration will be described below with reference to FIG. 4 based on the results of our experiments conducted with use of the toner replenishing device 20 and developing apparatus shown in FIG. 1.

The experiments were conducted under the following conditions:

Developing sleeve 12
Diameter: 31 mm, speed of rotation: 170 r.p.m., bias voltage: −300 V.
Insulative layer formed conductive
Diameter: 30 mm, speed of rotation: 170 r.p.m., bias voltage—800 V, thickness of insulative layer; 40μ,
The developing sleeve 12 was spaced apart from the roller 22 by about 2.4 mm.
The toner dispenser recessed portions 23 had a capacity to replenish up to 0.4 g of toner per second. The recessed portions were so designed that about 80% of the toner filling the recessed portions was replenished to the developer tank 11 by gravity, with the remaining portion, about 20%, of the toner being retained therein by mechanical and electrostatic attracting forces against gravity.

When entirely black original images are continuously copied at a developer concentration of 4.25 wt. % using the conductive roller 22 which is ao rotated as to replenish toner at a rate of up to 0.40 g per second with its recessed portions 23, the supply of toner is equal to the amount of toner consumed (the amount deposited on the drum 1+ the amount receovered by the roller 22=0.4 g/s, so that the developer concentration is maintained approximately at 4.25 wt. %. Next, when copying operation is conducted with deposition of a very small amount of toner onto the photosensitive drum 1 (development of entirely white original images), the amount of toner consumed at this time (the amount deposited on the drum 1 (Curve B)+ the amount recovered by the roller 22 (Curve C) is 0.24 g/s as given by Curve E at the developer concentration of 4.25 wt. %. Thus in the initial stage, the developer concentration rises at a rate of 0.40 g−0.24 g=0.16 g per second from Point F as indicated by the arrow a. If the copying operation is continued in this state, the increasing rate of the toner supply decreases as indicated by the arrow b, because the amount of toner recovered by the roller 22 increases with the rise in the developer concentration and also because the rise in the concentration leads to an increase in the toner concentration on the developing sleeve 12, permitting the carrier c to retain a sufficient amount of toner t before coming into contact with the roller 22, with the result that the toner thd 1 lodged in the recessed portions 23 of the roller 22 is left almost intact. Eventually none of the toner particles $t_1$ will be rubbed off by the carrier c. As a result, the toner supply is limited only to the amount falling under gravity (namely about 80% of the amount filling the recessed portions 23). Finally, therefore, the developer concentration levels off at about 5.90 wt. % as given by Point C on Curve E at the toner amount of about 0.32 g/s. This concentration is maintained.

When a copying operation is subsequently conducted with the deposition of a very large amount of toner onto the photosensitive drum 1 (development of entirely black original images), the amount of toner then consumed (the amount deposited on the drum 1 (Curve A) + the amount recovered by the roller 22 (Curve C) ) is 0.55 g/s as given by Curve D at the developer concentration of 5.90 wt. %. Thus the developer concentration drops at a rate of 0.55 g−0.32 g=0.23 g per second from Point C as indicated by the arrow d. If the copying operation is further continued, the rate of reduction in the developer concentration decreases as indicated by the arrow e for reasons contrary to those for which the variation from the arrow a to the arrow b occurs. Thus the decreased rate is attributable to the fact that with decrease in the developer concentration, the amount of toner recovered by the roller 22 decreases and the toner concentration on the developing sleeve 12 also decreases, permitting the carrier c to retain only a small amount of toner t before coming into contact with the roller 22 and to attract a progressively increasing amount of toner $t_1$ from the recessed portions 23 of the roller 22. Eventually the toner reaches a maximum of 0.40 g/s which is the amount withdrawn from the toner tank 21 by the recessed portions 23, namely the amount of toner falling under gravity and the amount of toner $t_1$ electrostatically attracted by the carrier c on the developing sleeve 12. The maximum supply is equal to the amount of toner consumed for the development of entirely black original images. The developer concentration is maintained at about 4.25 wt. % as given by Point F on Curve D at the toner consumption amount of 0.40 g/s.

According to the present embodiment, the toner withdrawn from the recessed dispenser portions in the periphery of a roller to which voltage is applied is partly supplied by gravity at a constant rate, and a suitable amount of the remainder of the toner is electrostatically removed from the recessed portions by the carrier on the developing sleeve after the carrier has been used for development. On the other hand, some of the toner retained on the carrier after development is recovered by the peripheral surface of the roller 22. Consequently despite the variations in the amount of toner consumed (the amount of toner deposited on the photosensitive element) due to variations in the amount of charges on the latent images on the photosensitive element, the developer concentration, which is variable in porportion to the amount of charges on the latent images, can be maintained with the range of from Point F (4.25 wt. %) to Point C (5.90 wt. %) shown in FIG. 4. Moreover the present device, which incorporates a toner replenishing and recovering roller only as an additional member, can be fabricated inexpensively because of its simple and compact construction.

Figure 5:
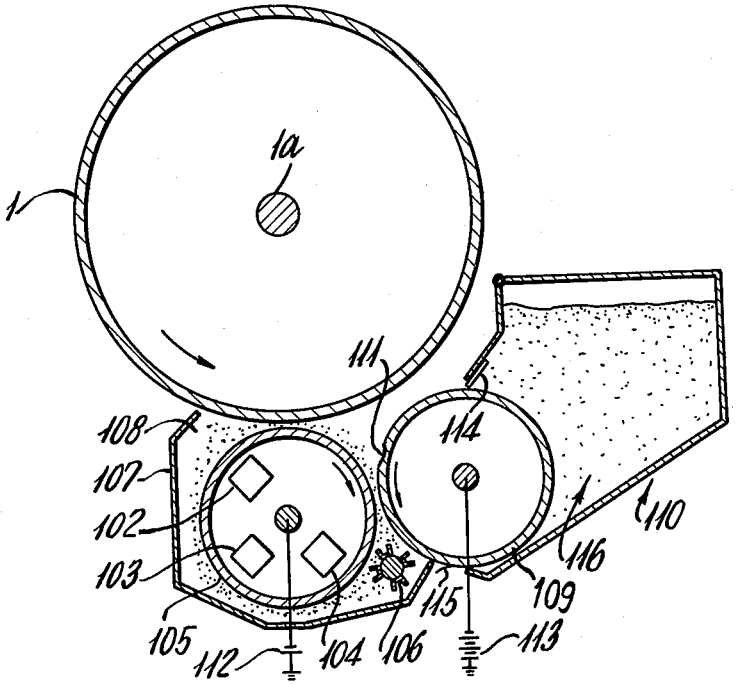
FIG. 5 is a transverse sectional view of another automatic toner replenishing device and developing apparatus according to the present invention.
Figure 6:
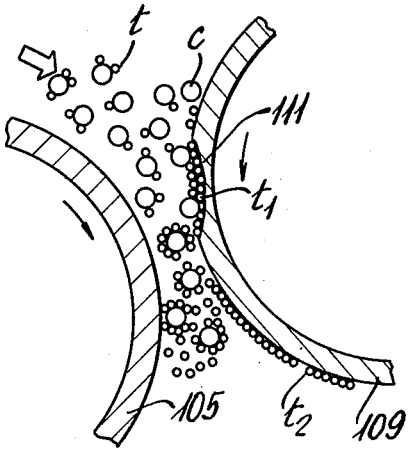
FIG. 6 is an enlarged fragmented transverse sectional view of the main part thereof.

Referring now to FIGS. 5 and 6 which illustrate another embodiment of the present invention, a rotatable developing sleeve 105 opposed to a photosensitive drum 1 has stationary magnets 102, 103, 104 in its interior. The sleeve 105 and a stirring member 106 are housed in a receptacle or frame 107 and define a developing unit. Particles of a two-component developer 108 composed of a magnetic carrier having an electrically insulative peripheral surface and a toner are influenced by the internal magnets of the sleeve 105 to form a brush, which develops the latent electrostatic images on the photosensitive drum in sliding contact therewith. A conductive roller 109 not formed with an insulative layer on its peripheral surface is opposed to the peripheral face of the developing sleeve in proximity with a peripheral portion of the sleeve downstream from the developing station with respect to the flow of the developer. The roller 109 is provided in part of the frame 107 and in part of a toner containing tank 110 where one is open to the other. The roller 109 is driven in timed relation to the sleeve 105 in an opposite direction to the sleeve. The roller 109 is formed in a portion of its peripheral surface with toner dispenser recessed portions 111 aligned axially or longitudinally thereof and are similar to the recessed portions 23 shown in FIG. 2. A bias voltage source 112 is connected to the developing sleeve 105, and another bias voltage souce 113 is connected to the roller 109 to produce a potential difference between the sleeve and the roller.

The opening of the toner tank 110 in which the roller 109 is disposed is provided with a doctor and scraping blade 114 at its upper portion and a seal member 115 such as a Mylar film at its lower portion. The scraping blade 114 which is made of elastic material is in sliding contact with the periphery of the roller to scrape toner off the peripheral surface other than the recessed portions.

With the construction described above, some of the toner 116 contained in the toner tank 110 is deposited into the recessed portions 111 of the roller and is regulated by the scraping blade 114 to a predetermined quantity, which alone is fed to an A portion within the frame 107.

Considering the behavior of the developer with reference to FIG. 6 which shows the A portion on an enlarged scale with the rotation of the developing sleeve 105, beads of carrier c reach the A portion with only a small amount of toner t clinging to the surfaces of the beads after a substantial amount of toner has been consumed for development. The carrier c rubs off the replenished toner $t_1$ from the recessed portions 111, and the resulting mixture of toner 116 and carrier 117 advances downward toward the stirring member 106. With a potential difference present between the sleeve 105 and the roller 109, the amount of toner advancing toward the developing station along with the carrier c is kept constant by virtue of the capacitance of the toner t and carrier c passing between the sleeve and the roller, while an excessive amount of toner $t_2$ is electrostatically attracted to the periphery of the roller and returned into the toner tank 110. Thus the roller 109 supplies a specified quantity of toner from the toner tank to the frame 107 with its recessed portions 111 and also recovers an excess of toner with its peripheral surface by electrostatic attraction.

The toner advancing downward along with the carrier is stirred therewith by the stirring member. The resulting triboelectrification gives the toner the polarity and charges required for development, and the toner advances toward the developing station with the rotation of the developing sleeve.

When the latent images on the photosensitive drum have a very small amount of charges with almost no toner consumed for the development, the carrier beads c arriving at the A portion in FIG. 6 retain a substantially sufficient amount of toner particles t around the carrier bead surfaces, so that the toner t in the recessed portions 111, although rubbed off from the recessed portions by the carrier c, is predominantly recovered by the roller surface as attracted thereto. Consequently the carrier advances along with the toner retained thereon the unused for the development.

Although varying amounts of toner may be consumed for different original images, the amount of toner in the developer to be fed to the developing station is maintained at a constant level at all times by the roller 109 which dispenses a specified amount of toner and recovers an excess of toner.

The amount of toner to be replenished to the developing station by the roller recessed portions is set at a maximum to be used for making one copy, for example at about 0.5 g per copy for use in a copying machine for making copies of up to A4 size.

The potential difference across the roller and the developing sleeve, which determines the amount of toner fed to the developing station, is suitably determined in accordance with the size of the developing apparatus, material of the developer, etc. The potential difference, when variable, is usble for controlling the density of the copy images.

When 1000 copies were continually made from each of an original of entirely black images and another original of entirely white images with use of the developing apparatus described above, the operation produced little or no variations in the initial toner concentration of the developer in the apparatus.

Further when tested fro continually copying originals of varying cumulative image densities, the apparatus reproduced the images with good results.

To sum up, the toner replenishing device of the second embodiment comprises a single roller which replenishes a specified quantity of toner and also recovers an excess of toner. The device is therefore very efficient and has another advantage that the potential difference provided between the developing sleeve and the roller assures the recovery of any excess of toner with high reliability and stability.

As described in the both embodiments, when the peripheral surface of the magnetic carrier is electrically conductive, the roller to which voltage is applied requires its peripheral suface to be formed with an insulative layer. This is so, since without the insulative layer the voltage applied to the roller causes the carriers to be similarly applied with voltage when the magnetic brush contacts the peripheral surface of the roller, thereby preventing electrostatic attraction of toner onto the roller. With the roller formed with insulative layer, no voltage will be applied to the carriers permitting toner to be attracted onto the roller.

On the other hand, when the peripheral surface of the magnetic carrier is electrically insulative, the roller to which voltage is applied may simply be a conductive roller with no insulative layer on its peripheral surface, as the insulative peripheral surface of the carrier functions as a barrier against voltage. Needless to say, the roller may be formed with an insulative layer even if the carrier is electrically insulative.

Although a row of recessed portions are formed in the roller of the embodiments described, a plurality of such recessed portions may be formed in each of at least two rows or in a staggered arrangement or the like.

We claim:

1. In a dry-type developing apparatus for converting electrostatic latent images into visible images with a two-component developer composed of a triboelectrically chargeable toner and a magnetic carrier and conveyed to a developing station by a developing sleeve having a plurality of magnets arranged in its interior, an automatic toner replenishing device comprising:

a roller to which voltage is applied having at least one recessed toner disperser portions and a toner recovering surface portion on its periphery and rotatable in contact with a portion of the developer on said sleeve after the developer portion has passed through the developing station;

means for producing a potential difference between said sleeve and said roller for recovering the toner; and a toner tank arranged to cover part of said roller and containing the toner to be replenished.

2. The automatic toner replenishing device of claim 1 which further comprises:

a blade held in sliding contact with the peripheral surface of said roller, whereby the toner particles adhering to the peripheral surface other than the recessed toner dispenser portions are scraped off into said toner tank, while allowing a predetermined quantity of toner to fill the recessed portions.

3. The automatic toner replenishing device of claim 1 wherein said roller is located at an upper portion of said sleeve, whereby as said roller rotates, the recessed toner dispenser portions serve to replenish said developer tank with a portion of the toner contained in the recessed portions by virtue of gravity and also to carry another portion of the toner as mechanically or electrostatically attracted thereto to the position where the toner portion is brought into contact with the carrier moving on said sleeve.

4. The automatic toner replenishing device of claim 1 wherein said toner recovering surface portion of said roller is the roller peripheral surface exept for the recessed portions of said roller.

5. The automatic toner replenishing device of claim 1 wherein said roller is provided at the side of said sleeve and rotatable in an opposite direction to that of the developer moving on said sleeve, whereby as said roller rotates, the recessed toner dispenser portions serve to replenish a specified quantity of toner from said toner tank to said developer tank and the toner recovering surface portion serves to recover an excess of toner to said toner tank by electrostatic attraction.

6. The automatic toner replenishing device of claim 3, wherein said roller is positioned parallel to said sleeve in proximity thereto and in opposed relation to the magnet housed in said sleeve.

7. The automatic toner replenishing device of claim 5, wherein said roller is positioned parallel to said sleeve in proximity thereto and at a peripherally offset position relative to the magnet housed in said sleeve.

8. The automatic toner replenishing device of claim 1 wherein said recessed portions are formed in the peripheral surface of said roller with a plurality of said recessed portions extending longitudinally thereof.

9. The automatic toner replenishing device of claim 8, wherein said recessed portions are located at peripherally spaced and longitudinally spaced positions on said periphery of said conductive roller.

10. The automatic toner replenishing device of claim 2 wherein said roller is above and parallel to said sleeve and said magnets are positioned to magnetically produce bristles of developer extending from said developing sleeve to said roller and comprising a receptacle containing said developer in which said developing sleeve is partially immersed and located below said toner tank, a stirrer member located in said receptacle and a blade slideably engaging the peripheral face of said sleeve below said roller and inclined into said receptacle for separating developer from said sleeve following said developing station and receiving toner separated from said roller and conveying said separated toner and developer toward said stirrer.

11. The automatic toner replenishing device of claim 2 wherein said roll is substantially horizontally offset from and parallel to said developing sleeve and further comprising a receptacle containing said developer in which said developing sleeve is at least partially immersed, said developer receptacle and toner tank being laterally mutually spaced and having confronting side openings with which said roller registers, said blade extending along the upper edge of said toner tank side opening and in slideable engagement with the peripheral face of said roller and said developer sleeve and roller rotating in opposite directions with their confronting faces advancing downwardly.

12. In a dry-type developing apparatus for converting electrostatic latent images into visible images with a developer including a triboelectrically chargeable toner and a magnetic carrier and conveyed to a developing station by a developing sleeve having a magnet member in its interior, an automatic toner replenishing device comprising a source of developer in communication with said developing sleeve, a source of toner and a transfer member containing metering recesses for mechanically carrying and conveying toner at a predetermined rate from said toner source to said developer source and having a peripheral surface for electrostatically withdrawing excess toner from said developing sleeve following said developing station and returning said excess toner to said toner source.

13. The automatic toner replenishing device of claim 12 wherein said transfer member comprises a rotatable cylinder to which voltage is applied parallel to the proximate said developing sleeve following said developing station and exposed to toner in said toner source and having said metering recesses in the periphery thereof and means for producing a potential difference between said sleeve and said cylinder peripheral surface.

14. The automatic toner replenishing device of claim 13 wherein said toner source comprises a toner carrying receptacle having a lower opening, said cylinder registering with said opening and a scraper blade slideably engaging the periphery of said cylinder for separating toner from said peripheral surface and for regulating the quantity of toner carried by said recesses.

15. The automatic toner replenishing device of claim 2 wherein said roller consists of a conductive roller formed with an insulative layer on its peripheral surface, said carrier having an electrically conductive peripheral surface.

16. The automatic toner replenishing device of claim 1 wherein said roller consists of a conductive roller formed with an electrically conductive peripheral surface, said carrier having an electrically insulative peripheral surface.

* * * * *